United States Patent [19]

Develay et al.

[11] 4,439,246

[45] Mar. 27, 1984

[54] METHOD OF MAKING HOLLOW BODIES UNDER PRESSURE FROM ALUMINUM ALLOYS

[75] Inventors: Roger Develay, Seyssinet Pariset; Marc Anagnostidis, Chamalieres, both of France

[73] Assignee: Societe Metallurgique de Gerzat, Paris, France

[21] Appl. No.: 394,179

[22] Filed: Jul. 1, 1982

[30] Foreign Application Priority Data

Jul. 22, 1981 [FR] France ..... 81 14790

[51] Int. Cl.[3] ..... C22F 1/04; C22C 21/10

[52] U.S. Cl. ..... 148/2; 148/11.5 A; 420/532

[58] Field of Search ..... 148/2, 3, 11.5 A; 72/85; 29/527.5, 527.7; 420/532

[56] References Cited

U.S. PATENT DOCUMENTS 3,469,433 9/1969 Fresch et al. ..... 148/11.5 A
3,847,681 11/1974 Waldman et al. ..... 148/11.5 A
4,305,763 12/1981 Quist et al. ..... 148/2

FOREIGN PATENT DOCUMENTS 711859 7/1954 United Kingdom ..... 148/11.5 A

*Primary Examiner*—L. Dewayne Rutledge
*Assistant Examiner*—Robert L. McDowell
*Attorney, Agent, or Firm*—Oblon, Fisher, Spivak, McClelland & Maier

[57] ABSTRACT

A hollow body from an aluminum alloy is prepared by a method of manufacturing a hollow body under pressure from an aluminum alloy, comprising the steps of:

(1) preparing an alloy of a composition consisting of (by weight) $5.6 \leqq Zn \leqq 6.1$, $2.0 \leqq Mg \leqq 2.4$, $1.3 \leqq Cu \leqq 1.7$, $0.15 \leqq Cr \leqq 0.25$, $Fe \leqq 0.10$, $Fe+Si \leqq 0.25$, $Mn \leqq 0.04$, $Zr \leqq 0.03$, $Ti \leqq 0.04$, with the remainder of the alloy being aluminum and impurities with the total amount of impurities being no more than 0.15 with the maximum amount of any given impurity being 0.05;

(2) casting the alloy in the form of a billet;

(3) hot extruding a billet at a temperature between 350° and 450° C. by the indirect process into the form of a case;

(4) drawing out the resultant case hot then cold;

(5) hot necking the drawn case between 350° and 450° C.;

(6) solution annealing the hot necked case between 450° and 490° C. and quenching the case with water at a temperature below 40° C.; and (7) two step tempering (type T73) the quenched case.

5 Claims, 5 Drawing Figures

METHOD OF MAKING HOLLOW BODIES UNDER PRESSURE FROM ALUMINUM ALLOYS

BACKGROUND OF THE INVENTION

1. Field of the Invention

The present invention relates to a method of making hollow bodies such as containers, bottles and the like under pressure from aluminum alloys, type 7475 (as defined by the Aluminum Association) which possess both high resistance and good fracture elongation.

2. Description of the Prior Art

Very light containers, which contain fluids under pressure, and particularly those used for transporting and storing compressed or liquefied gases, have so far been made of type 2001 aluminum alloy (as defined by the Aluminum Association, edition of 1st June 1980). Now, if the use of a product made from an alloy requires the alloy to have excellent resistance to stress corrosion, which is a fundamental requirement for containers under pressure, a very intensive thermal tempering treatment has to be applied to the alloy which results in reduction in fracture elongation of the alloy. In particular, an acceptable hollow container must comply with international regulations in force or in preparation relating to the extent of elongation and the shape of the tear in the container incurred when a hollow body is subjected to a bursting test under hydraulic pressure.

In the making of hollow bodies under pressure, it is necessary that the product obtained have the same mechanical properties (and thus the same lightness) and the same resistance to stress corrosion (and thus the same degree of safety) as hollow body products obtained from alloy 2001. Hollow body products must also satisfy international regulations from the point of view of the extent of elongation and appearance of the tear in the container which a test specimen exhibits during a prescribed bursting test under hydraulic pressure.

SUMMARY OF THE INVENTION

Accordingly, one object of the present invention is to provide a hollow body made from an aluminum alloy other than type 2001 aluminum alloy which possesses satisfactory mechanical and stress properties.

Accordingly, this object and other objects of the present invention, as hereinafter will become more readily apparent, can be attained by a method for manufacturing hollow bodies under pressure from aluminum alloys by (a) preparing an alloy of the composition consisting of (by weight) $5.6 \leqq Zn \leqq 6.1$, $2.0 \leqq Mg \leqq 2.4$, $1.3 \leqq Cu \leqq 1.7$, $0.15 \leqq Cr \leqq 0.25$, Fe is no more than 0.10, Fe+Si is no more than 0.25, Mn is no more than 0.04, Zr is no more than 0.03, Ti is no more than 0.04, with the remainder aluminum and a total amount of impurities no more than 0.15 with the maximum for any given impurity being 0.05; (b) casting the alloy in the form of a billet; (c) hot extruding a billet at a temperature between 350° and 450° C. by the indirect process into the form of a case; (d) drawing out the resultant case hot then cold; (e) hot ribbing necking the drawn case between 350° and 450° C.; (f) solution annealing the hot ribbed case between 450° and 490° C. and quenching the case with water at a temperature below 40° C.; and (g) two step tempering (type T73) the quenched case.

DETAILED DESCRIPTION OF THE PREFERRED EMBODIMENTS

The hollow body product of the present invention has the following characteristics:

(a) Mechanical resistance $R_{0.2} \geqq 370$ MPa, $R_m \geqq 460$ MPa, $A\% \geqq 12$;

(b) Stress corrosion under tension with 75% of $R_{0.2}$ guaranteed, i.e. 280 MPa, for a duration of at least 30 days of immersion into and removal (10–50 minutes) from a 3.5% solution of NaCl at room temperature on C test pieces under the conditions of ASTM standard 38-73;

(c) Behavior of test piece during bursting test under hydraulic pressure:

There must be a ductile rupturing of a body of a generally cylindrical shape. The break or tear must be largely longitudinal; the tear must not be branched; the tear must not extend more than 90° on either side of the main portion of the tear or brake; and the tear or brake must not extend into a portion of the body having a thickness of over 1.5 times the maximum thickness measured in the middle of the body.

It has been observed that steps 3 and 4 of the present process may be replaced by a single cold extrusion operation. Furthermore the content of Fe is preferably kept below 0.08% and the content of Fe+Si is no more than 0.18%.

Figure 3A:
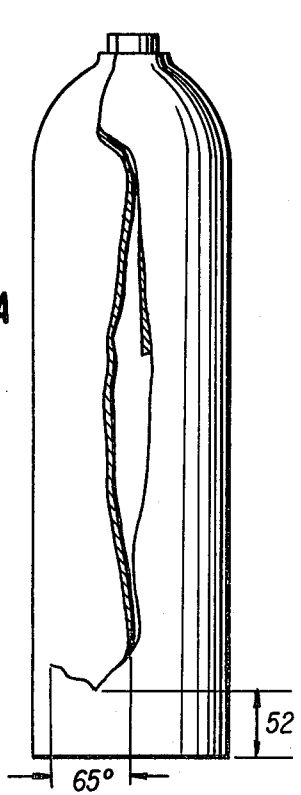
Figure 3B:
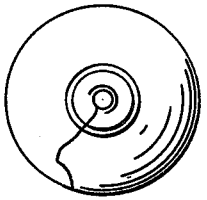
Figure 2A:
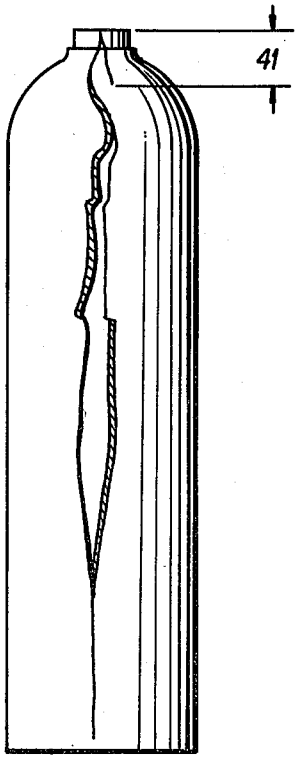
Figure 2B:
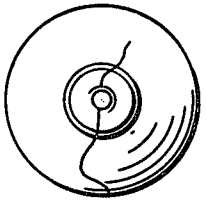
Figure 1:
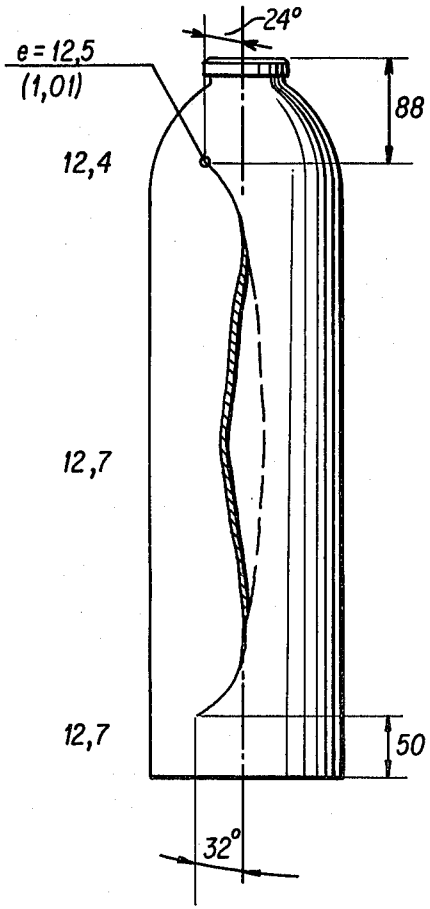

The following examples illustrate the results obtained by applying the method of the present invention to the manufacture of 6 liter bottles of diameters 127×151 mm, where the pressure during use is 30 Mpa and the testing pressure is 45 MPa. FIGS. 1 to 3 show some characteristic rupture or tear shapes following the bursting of test specimens under pressure, the dimensions being in millimeters.

Three castings were made: A (according to the invention), and B and C (outside the scope of the invention), each having the following compositions (% by weight).

| | Fe | Si | Cu | Cr | Mg | Zn | Ni | Mn | Zr | Ti |
|---|---|---|---|---|---|---|---|---|---|---|
| A | 0.05 | 0.03 | 1.30 | 0.20 | 2.25 | 5.70 | <0.01 | <0.02 | <0.02 | <0.03 |
| B | 0.11 | 0.06 | 1.45 | 0.20 | 2.05 | 5.60 | <0.01 | <0.02 | <0.02 | <0.03 |
| C | 0.13 | 0.08 | 1.40 | 0.19 | 2.16 | 5.65 | <0.01 | <0.02 | <0.02 | <0.03 |

The alloys were cast in the form of billets having a diameter of 170 mm and homogenized for 12 hours at 465° C.

After machining (scalping) the billets to a diameter of 158.5 mm, blooms were drawn by inverse extrusion and drawn out hot at 400° C.±10° C., then machined to a diameter of 155 mm and annealed at 420° C. for 4 hours. After pickling treated objects were drawn cold with an elongation (S−s)/s of 13.5% and brought to the final length.

The open part of the case thus obtained is necked at 400° C., pierced and cut.

The heat treatment applied was as follows:

solution anneal at 465° C.±1.5° C. for 2 hours
quenching with cold water (10°–20° C.)
first temper 6 hours at 105° C.±2° C.
second temper 12 hours at 177° C.±1.5° C.

The bottle was finished by machining the neck and placing the ring on the bottle.

A bottle from each casting was subjected to traction tests: 4 test pieces at full body thickness of the bottle (lengthwise).

Two bottles from each casting were tested for bursting under hydraulic pressure.

Finally, bottle samples were tested for corrosion under tension: not a crack appeared in the test pieces after 30 days of testing.

The results of the mechanical tests are shown in Table 1. The test data show the excellent stress corrosion characteristics of the test samples, the bottles also showing no pitting or exfoliating corrosion.

The tests show that in order to achieve a product hollow body within the scope of the present invention, all of the stages of the present method must be duplicated. This is particularly true of the morphology of the tear (rupture) in the bottle which occurs in the hydraulic bursting test.

TABLE 1

| Casting ref. | Mechanical properties $R_{0.2}$(MPa) mean | $R_{0.2}$(MPa) minimum | Rm (MPa) mean | Rm (MPa) minimum | A % mean | A % minimum | Bursting tests: Bursting pressure (MPa) | Plastic deformation pressure (MPa) | Increase in volume % | Appearance of tear | FIG. |
|---|---|---|---|---|---|---|---|---|---|---|---|
| A | 411.25 | 406 | 480.25 | 476 | 15.15 | 15.0 | 89.2 | 78.4 | 14.1 | Very good | 1 |
| | | | | | | | 90.0 | 78.0 | 15.7 | Very good | — |
| B | 386.00 | 384 | 465.00 | 460 | 14.28 | 13.75 | 87.2 | 74.0 | 14.3 | Bad | 2 |
| | | | | | | | 87.2 | 75.0 | 14.9 | Bad | — |
| C | 402.15 | 390 | 470.50 | 467 | 14.35 | 13.85 | 88.4 | 77.6 | 14.4 | Bad | 3 |
| | | | | | | | 89.1 | 77.9 | 14.8 | Bad | — |

Having now fully described this invention, it will be apparent to one of ordinary skill in the art that many changes and modifications can be made thereto without departing from the spirit or scope of the invention as set forth herein.

What is claimed as new and is intended to be secured by Letters Patent is:

1. A method of manufacturing a hollow body under pressure from an aluminum alloy, comprising the steps of:

(1) preparing an alloy of a composition consisting of (by weight) $5.6 \leqq Zn \leqq 6.1$, $2.0 \leqq Mg \leqq 2.4$, $1.3 \leqq Cu \leqq 1.7$, $0.15 \leqq Cr \leqq 0.25$, $Fe \leqq 0.10$, $Fe+Si \leqq 0.25$, $Mn \leqq 0.04$, $Zr \leqq 0.03$, $Ti \leqq 0.04$, with the remainder of the alloy being aluminum and impurities with the total amount of impurities being no more than 0.15 with the maximum amount of any given impurity being 0.05;

(2) casting the alloy in the form of a billet;

(3) hot extruding a billet at a temperature between 350° and 450° C. by the indirect process into the form of a case;

(4) drawing out the resultant case hot then cold;

(5) hot necking the drawn case between 350° and 450° C.;

(6) solution annealing the hot necked case between 450°and 490° C. and quenching the case with water at a temperature below 40° C; and (7) two step tempering (type T73) the quenched case.

2. The method of claim 1, wherein the Fe content of said alloy ranges up to 0.08%.

3. The method of claim 1 or 2, wherein the Fe+Si content of said alloy ranges up to 0.18%.

4. The method of claim 1 or 2, wherein said drawn out case is hot ribbed at 400° C., pierced and cut, solution annealed at 465° C.±1.5° C. for 2 hours, quenched with cold water at 10°-20° C., tempered at 105° C.±2° C. for 6 hours and finally tempered at 177° C.±1.5° C. for 12 hours.

5. A method of manufacturing a hollow body under pressure from an aluminum alloy, comprising the steps of:

(1) preparing an alloy of a composition consisting of (by weight) $5.6 \leqq Zn \leqq 6.1$, $2.0 \leqq Mg \leqq 2.4$, $1.3 \leqq Cu \leqq 1.7$, $0.15 \leqq Cr \leqq 0.25$, $Fe \leqq 0.10$, $Fe+Si \leqq 0.25$, $Mn \leqq 0.04$, $Zr \leqq 0.03$, $Ti \leqq 0.04$, with the remainder of the alloy being aluminum and impurities with the total amount of impurities being no more than 0.15 with the maximum amount of any given impurity being 0.05;

(2) casting the alloy in the form of a billet;

(3) cool extruding said billet;

(4) hot necking the drawn case between 350° and 450° C;

(5) solution annealing the hot necked case between 450° and 490° C. and quenching the case with water at a temperature below 40° C.; and (6) two step tempering (type T73) the quenched case.

* * * * *